US009289353B2

(12) United States Patent
Ta

(10) Patent No.: US 9,289,353 B2
(45) Date of Patent: Mar. 22, 2016

(54) PEDICURE BASIN WITH OVERFLOW PROTECTION

(71) Applicant: Lan Van Ta, Cucamonga, CA (US)

(72) Inventor: Lan Van Ta, Cucamonga, CA (US)

( * ) Notice: Subject to any disclaimer, the term of this patent is extended or adjusted under 35 U.S.C. 154(b) by 482 days.

(21) Appl. No.: 13/795,862

(22) Filed: Mar. 12, 2013

(65) Prior Publication Data

US 2014/0259374 A1 Sep. 18, 2014

(51) Int. Cl.

| | |
|---|---|
| ***A47K 3/022*** | (2006.01) |
| ***A61H 35/00*** | (2006.01) |
| ***A61H 33/00*** | (2006.01) |

(52) U.S. Cl.

CPC ..... *A61H 35/006* (2013.01); *A61H 33/6084* (2013.01); *A61H 2201/0149* (2013.01)

(58) Field of Classification Search

CPC ..... A61H 35/006

USPC ..... 4/621, 622

See application file for complete search history.

(56) References Cited

U.S. PATENT DOCUMENTS

| | | | | |
|---|---|---|---|---|
| 7,950,079 | B2 * | 5/2011 | Ta | 4/622 |
| 2014/0150176 | A1 * | 6/2014 | Tran | 4/622 |

* cited by examiner

*Primary Examiner* — Tuan N Nguyen

(74) *Attorney, Agent, or Firm* — Miller Law Group, PLLC

(57) ABSTRACT

A spa chair with a novel pedicure basin is disclosed. The pedicure basin has a main basin and a secondary basin. The main basin is where the feet of the person sitting in the spa chair goes. This main basin is generally filled with water. In one embodiment, the main basin has water overflow protection through a lowered rim, directing the overflow of water to a secondary basin. This method of overflow protection is especially useful where the main basin has a liner blocking the drain hole within the main basin.

7 Claims, 4 Drawing Sheets

PEDICURE BASIN WITH OVERFLOW PROTECTION

BACKGROUND OF THE INVENTION

1. Field of the Invention

This invention relates to a pedicure basin, specifically a pedicure basin with overflow protection.

2. Description of the Related Art

Professional salons today allow customers to receive numerous services, such as facials, manicures, and pedicures. To facilitate these services, spa chairs are often used to allow clients to sit and relax while they receive facials, manicures, and pedicures. Such spa chairs often include a pedicure basin at the foot of the chair to facilitate pedicure services and foot massages. The pedicure basin generally includes warm water for cleaning, comfort and to complement the massaging affect.

Reference is made to U.S. Pat. No. 7,950,979 issued May 31, 2011 to the present Applicant, the disclosure of which is incorporated herein by reference.

FIG. 1 in that patent is reproduced herein and is a diagram showing a prior art spa chair with a pedicure basin for the client's feet to soak in. This conventional pedicure basin has a drain at the bottom for draining the water present in the pedicure basin. However, although the water is drained out of the pedicure basin, residual is ultimate left behind, including possible bacteria, germs and other contaminates from the client's feet. If not thoroughly washed and sanitized, the next client to use the pedicure basin is exposed to the left behind bacteria and germs from the previous client. This poses a serious sanitation issue.

The potential of spreading germs among clients through various tools and equipment, including the pedicure basin, is well known within the manicure and pedicure industries. As such, it is common practice in the industry to apply a liner over the pedicure basin, which may be easily replaced for the next client. The liner is typically either a plastic bag type (like a trash bag) or a harder plastic that has been molded to fit like a shell in the pedicure basin. Utilizing a liner around the pedicure basin is cost effective and efficient, compared to the alternative of having to thoroughly clean and sanitize the pedicure basin after each use. With a liner applied over the pedicure basin, the drain is blocked. As such, a water-filled pedicure basin with a liner will commonly require that the plastic be punctured to drain the water into the drain hole of the pedicure basin. Alternatively, and less common, the water may be drained by pouring the water out over a sink. Thereafter, the used liner will be replaced, and the pedicure basin will be filled with new water for the next client.

The blockage of the drain by the liner poses another challenge. The drain is convenient for not only draining the water completely from pedicure basin, but also for partially draining the water from the pedicure basin. This may be convenient in the scenario where one client may want to adjust the temperature of the water in the pedicure basin. One easy means of doing this is by draining some of the water through the drain and adding additional warm water or cool water to adjust the water temperature within the pedicure basin. If some of the water is not drained, there is the possibility of overflowing the pedicure basin through the addition of the desired warm or cool water. Of course, with a liner, the drain is blocked, and thus the pedicure basin cannot be easily drained.

BRIEF SUMMARY OF THE INVENTION

The design for a new and improved pedicure basin is disclosed. This design may be applied to spa chairs with an integrated pedicure basin or removal pedicure basin. The design is particularly useful for pedicure basins where a liner blocks the drain hole.

This pedicure basin design is comprised of a main basin and a secondary basin that accommodates overflow of fluids (typically water) from the main basin. A portion of the rim, where the main basin is interconnected with a secondary basin, has a lower edge, thus allowing the fluid from the main basin to overflow to the secondary basin.

In another embodiment of this pedicure basin design, the secondary basin completely surrounds the main basin (, the secondary basin forming a ring shape if the main basin and secondary basin are circular), and allows for overflow of fluids from any part of the rim of the main basin to the secondary basin.

BRIEF DESCRIPTION OF THE DRAWINGS

A more complete appreciation of the invention and many of the advantages thereof will be readily obtained as the same becomes better understood by reference to the detailed description when considered in connection with the accompanying drawings, wherein.

DETAILED DESCRIPTION

Figure 1:
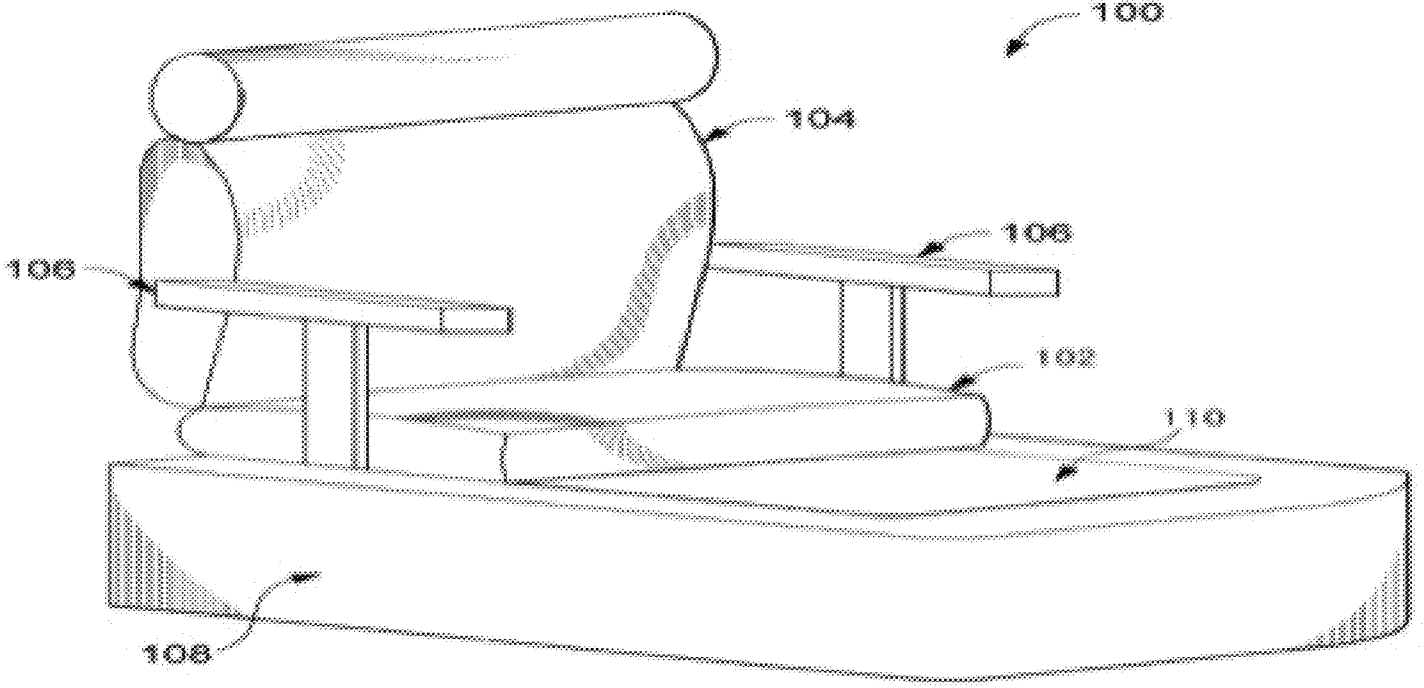
FIG. 1 (PRIOR ART)
FIG. 1 (PRIOR ART) shows a perspective view of a conventional spa chair with an integrated pedicure basin.

FIG. 1 shows a conventional spa chair 100 with a pedicure basin. Though FIG. 1 shows a spa chair with an integrated pedicure basin 110, and the pedicure basin 110 may be removable. In the case where the pedicure basin 110 is removable, the spa chair 100 will typically have a pedicure basin base 108 for holding the pedicure basin 110. In this case, the pedicure basin base 108 will allow for the water to drain from the pedicure basin's drain hole, through the pedicure basin base's drain hole (not shown). The spa chair 100 will typically also have a water inlet and faucet head for adding cold or hot water. Pedicure basins may take a variety of shapes and sizes. For example, they may be circular, square, and a variety of other shapes, mainly for aesthetic purposes.

The spa chair 100 includes a seat 102 connected to a backrest 104 and a pair of arm rests 106. The seat 102 of the spa chair 100 is further connected to a spa chair base 108, which also houses a pedicure basin 110. The pedicure basin 110 is located with the spa chair base 108, below and forward of the seat 102. The pedicure basin 110 is designed to hold a liquid such as water, and generally includes a drain in the bottom panel of the pedicure basin 110. A faucet (not shown) can optionally be attached to the pedicure basin 110 to allow liquid to be easily flowed into the pedicure basin 110.

In addition to the drain, there are some pedicure basins with an overflow drain, much like one would find in a standard sink. The overflow drain is usually in the side wall and near the top of the pedicure basin, and it's purpose is to allow water to drain before it can overflow. Both the drain and overflow drain would generally be blocked if a liner were used to cover the pedicure basin.

Figure 2A:
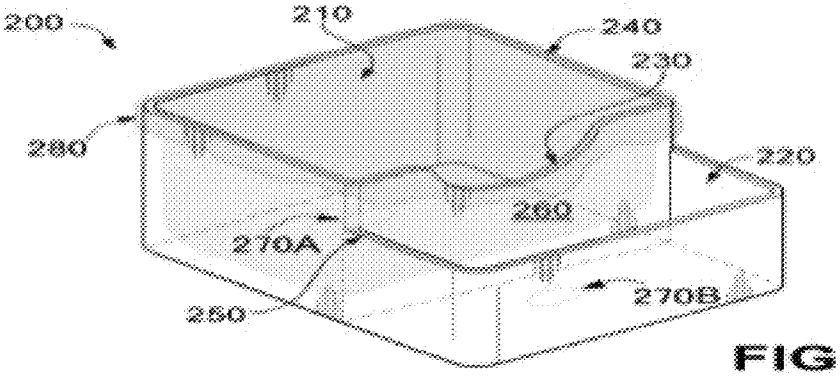
FIG. 2A shows a perspective view of an embodiment of a square-like pedicure basin with a secondary basin.

FIG. 2A shows a preferred embodiment of a pedicure basin with a secondary basin. The shape of this pedicure basin 200 is square-like with rounded corners. There is a main basin 210 and a secondary basin 220. The main basin 210 has four side walls and a bottom portion. There is a drain 270A at or near the bottom of this main basin 210. Attached to one side of the main basin is a secondary basin 220. This secondary basin 220 has four walls and a bottom portion. There is a drain 270B at or near the bottom of this secondary basin 220. In this embodiment, the secondary basin 220 shares a side wall with the main basin 210. In other embodiments, it is possible for the main basin 210 and secondary basin 220 to not share a side wall. It is also possible for the main basin and/or secondary basin to not have a drain.

In the pedicure basin of FIG. 2, a portion of the rim 240 on the main basin is intentionally lower. This is referred to as the lowered rim 230. The lowered rim 230 results in fluids overflowing from the main basin 210 to the secondary basin 220. The flow area is the area calculated from the shape comprised of the imaginary normal rim line and the lowered rim 230. The flow area determines the rate of fluid overflow that can be handled, which should be sufficiently large enough to accommodate the rate of fluid inflow into the main basin 210. As water overflows to the secondary basin 220, it will be drained through the drain hole 270B at or near the bottom of this secondary basin 220.

In this embodiment, the outer walls of the secondary basin have a lower height then the outer walls of the main basin. It can also be said that the rim 240 of the main basin is higher than the rim 250 of the secondary basin. However, in other embodiments, the rim of the secondary basin may be higher or the same than the main basin.

FIG. 2A also shows a liner 280 within the main basin 210. The liner 280 covers the inside portion of the main basin 210 and may also wrap around the rim 240 and lowered rim 260 of the main basin 210. The liner 280 is usually easily replaceable and prevents the sharing of contaminated liquids within the main basin from one user to another.

Figure 2B:
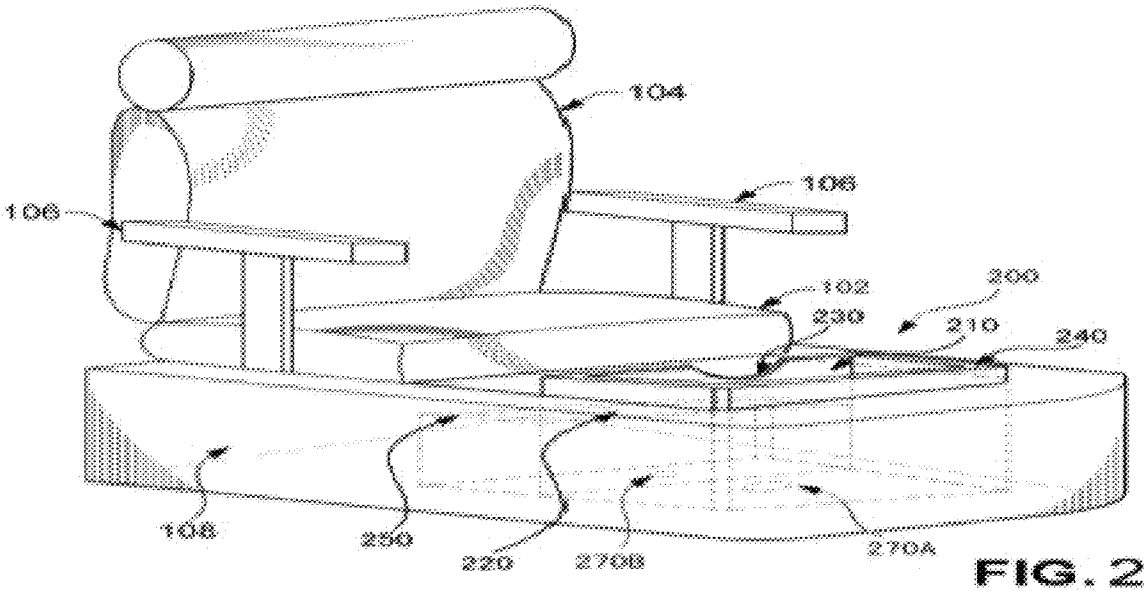
FIG. 2B shows a perspective view of an embodiment of a square-like pedicure basin incorporated into a spa chair.

FIG. 2B shows the pedicure basin of FIG. 2A integrated into a general spa chair. As can be seen, in this embodiment, the person sitting within the spa chair would have their feet placed within the main basin 210. As water is added to the main basin 210, it will overflow through the lowered rim 230 and into the secondary basin 220.

Figure 3A:
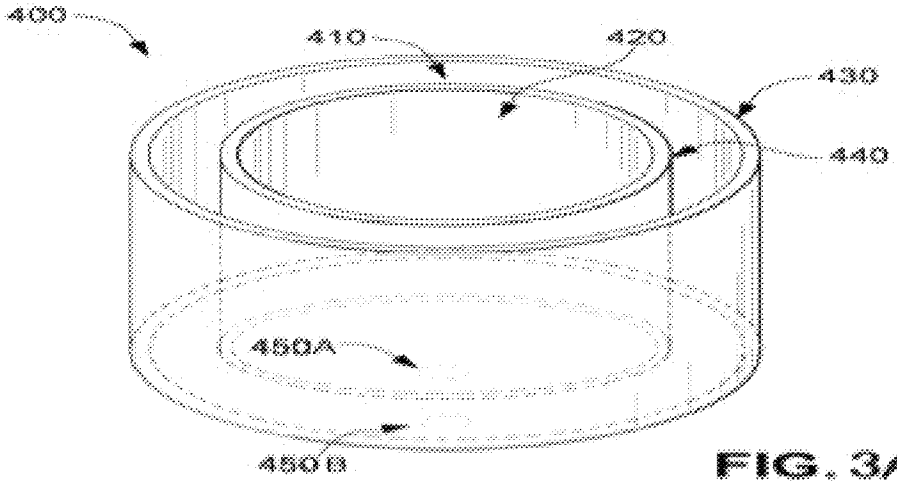
FIG. 3A shows a perspective view of an embodiment of a round pedicure basin with a secondary basin.
Figure 3B:
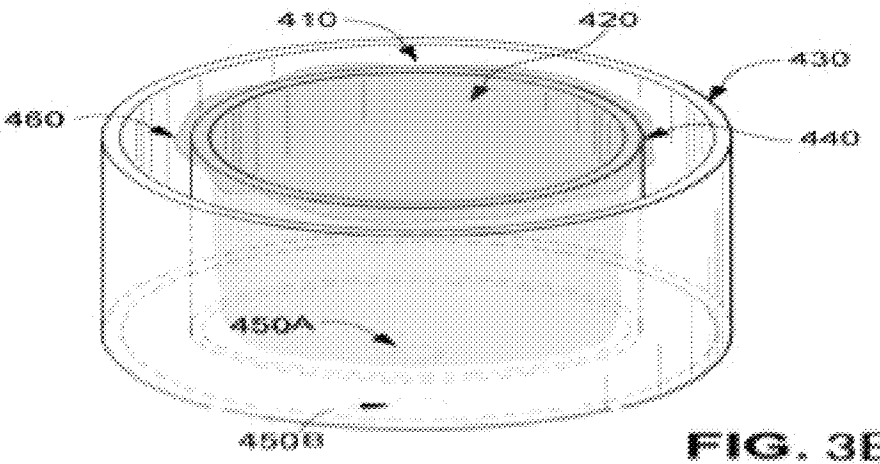
FIG. 3B shows a perspective view of an embodiment of a round pedicure basin with a liner.

FIG. 3A shows another embodiment where the shape of the main basin 420 is round, and where the secondary basin 410 is also round and encompasses the entire portion of the main basin 420. In this embodiment, the entire rim 440 of the main basin 420 can be considered lowered, and thus overflow can occur at any portion of the lowered rim for the fluid to overflow from the main basin 420 to the secondary basin 410. The height of the rim 430 of the secondary basin can be higher or lower than the height of the rim 440 of the main basin. In this embodiment, a drain hole 450A is shown for the main basin, as well as a drain hole 450B for the secondary basin. Both of these drain holes 450A 450B may or may not be present. When a liner 460 is used to cover the main basin 420, as displayed in FIG. 3B, the drain hole 450A of the main basin is rendered useless. Here, the drain hole 450B of the secondary basin may still be utilized.

Figure 4A:
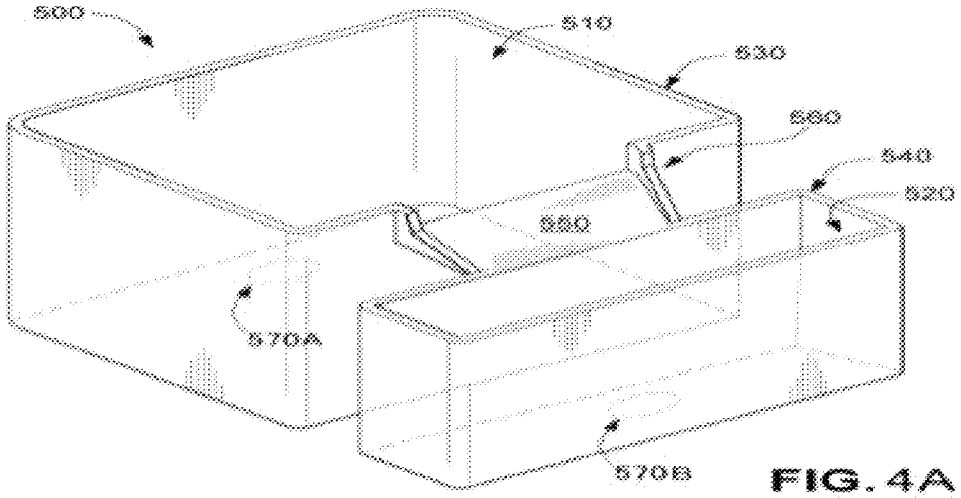
FIG. 4A shows a perspective view of an embodiment of a pedicure basin with a secondary basin where no walls are shared.

FIG. 4A shows another embodiment where the main basin 510 and secondary basin 520 do not share a side wall. In this embodiment, a lowered rim 560 exists on the main basin, and the same principle of having the overflow of fluids from the main basin 510 to the secondary basin 520 at the lowered rim 560 applies. In this embodiment, the fluid enters a slide (or spout) 550 from the lowered rim 560, and is led to the secondary basin 520. The rim 530 of the main basin 510 is higher than the rim 540 of the secondary basin in this embodiment.

Figure 4B:
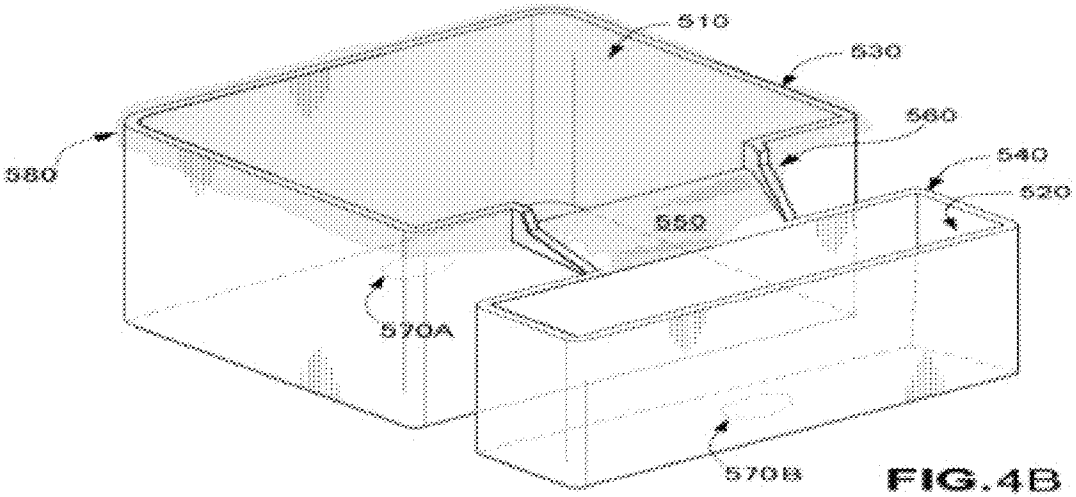
FIG. 4B shows a perspective view of an embodiment of a pedicure basin with a liner and a secondary basin where no walls are shared.

FIG. 4B demonstrates the addition of a liner 580 to the main basin 510. The liner renders the drain hole 570A of the main basin useless, and the drain hole 570B of the secondary basin may still be used. Both of these drain holes 570A 570B are optional.

As discussed above, a disposable liner is commonly used for sanitation purposes. The liner generally goes around the rim of the main basin. The liner may be utilized with a lowered rim, where the liner wraps around the entire rim of the main basin, including the lowered rim. For a plastic bag style liner, conforming the liner to the lowered rim occurs easily enough. A hard shell style liner requires that the liner be molded to conform to the rim, including the lowered rim. When the liquid overflows over the lowered rim, it would only be in contact with the liner, and would generally not have to come in contact with the main basin.

Having a secondary basin for overflow protection has many advantages. In case of accidental overflow, it will prevent the overflow from the main basin from hitting the floor. Also, as described above, there may be the desire for intentional overflow, where additional water is being added to the main basin for various purposes, including the intent to warm or cool the water in the main basin. The overflow system accommodates the use of a liner in the main basin, which is being performed in the industry due to sanitation needs.

The present invention has been described in an illustrative manner. It is to be understood that the terminology which has been used is intended to be in the nature of words of description rather than of limitation. While there have been described herein, what are considered to be preferred and exemplary embodiments of the present invention, other modifications of the invention shall be apparent to those skilled in the art from the teachings herein and, it is, therefore, desired to be secured in the appended claims all such modifications as fall within the true spirit and scope of the invention.

What is claimed is:

1. A spa chair for use by a spa patient in a pedicure of the feet of the patient, the spa chair comprising:

a seat arranged for receiving the patient in seating position thereon with the feet presented forwardly of the seat;

a main basin in front of the seat and arranged such that the feet of the patient sitting on the seat are received into the main basin;

the main basin having a peripheral rim for containing liquid in the main basin;

the main basin having at least a portion of the peripheral rim arranged at a lowered height relative to a prescribed height of the peripheral rim so that the liquid can overflow said at least a portion of the peripheral rim in the event that the liquid reaches a depth greater than that which can be contained in the main basin;

a liner covering a surface of the main basin up to the peripheral rim in an installed configuration;

and a secondary basin communicated with the main basin over said at least a portion of the peripheral rim so as to collect all overflow of liquid from the main basin that is directed by said at least a portion of the peripheral rim towards the secondary basin;

whereby, in the installed configuration of the liner, said at least a portion of the peripheral rim, which is arranged at the lowered height, provides transfer of liquid out of the main basin by overflow while the liner prevents contact of the liquid with the main basin where the patient's feet are received.

2. The spa chair of claim 1 wherein said secondary basin includes a drain hole.

3. The spa chair of claim 1 wherein said liner is a flexible plastic liner.

4. The spa chair of claim 1 wherein said liner is a hard shell liner conforming to the shape of said main basin.

5. The spa chair of claim 1 wherein said main basin and said secondary basin share a side wall, and said at least a portion of the peripheral rim is located at said shared side wall and is lowered relative to a main portion of the peripheral rim.

6. The spa chair of claim 1 wherein said at least a portion of the rim is lowered relative to a main portion of the peripheral rim and said at least a portion of the rim is located to direct liquids from said main basin to said secondary basin.

7. The spa chair of claim 1 wherein said main basin has the peripheral rim at a common lowered height to allow the overflow liquid to overflow around the full extent of the peripheral rim and wherein the secondary basin surrounds the full peripheral rim of the main basin.

* * * * *